US009640891B2

(12) United States Patent
Nakamura

(10) Patent No.: US 9,640,891 B2
(45) Date of Patent: May 2, 2017

(54) CONNECTOR

(71) Applicant: Japan Aviation Electronics Industry, Limited, Tokyo (JP)

(72) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/018,355

(22) Filed: Feb. 8, 2016

(65) Prior Publication Data

US 2016/0294094 A1 Oct. 6, 2016

(30) Foreign Application Priority Data

Apr. 6, 2015 (JP) ..... 2015-077821

(51) Int. Cl.

| | |
|---|---|
| ***H01R 12/00*** | (2006.01) |
| ***H01R 13/18*** | (2006.01) |
| ***H01R 13/11*** | (2006.01) |
| *H01R 12/58* | (2011.01) |
| *H01R 12/73* | (2011.01) |

(52) U.S. Cl.

CPC ..... *H01R 13/18* (2013.01); *H01R 13/112* (2013.01); *H01R 12/585* (2013.01); *H01R 12/73* (2013.01)

(58) Field of Classification Search

CPC .. H01R 9/096; H01R 23/725; H01R 13/6315; H01R 13/28; H01R 23/7073; H01R 13/26

USPC ..... 439/65, 74, 247, 248, 290–292, 660, 439/699.1

See application file for complete search history.

(56) References Cited

U.S. PATENT DOCUMENTS 5,556,286 A * 9/1996 Ikesugi ..... H01R 12/716 439/247
5,626,483 A * 5/1997 Naitoh ..... H01R 13/035 29/884
6,238,219 B1 * 5/2001 Wu ..... H01R 13/24 439/289
6,439,928 B1 * 8/2002 Akama ..... H01R 23/688 439/607.09

(Continued)

FOREIGN PATENT DOCUMENTS

JP 2013-55007 A 3/2013

*Primary Examiner* — Thanh Tam Le

(74) *Attorney, Agent, or Firm* — Muncy, Geissler, Olds & Lowe, P.C.

(57) ABSTRACT

A connector includes contact pairs arranged on and fixed to a housing, each of the contact pairs being consisted of two contacts that are insulated from each other, and elasticity-reinforcing members corresponding to the contact pairs, each of the elasticity-reinforcing members being not fixed to the housing but held by a corresponding contact pair among the contact pairs, wherein the two contacts constituting each contact pair respectively include contacting portions that come into contact with corresponding contacts of a counter-connector, are made of elastic contact pieces extending in a fitting direction with the counter-connector and are disposed such that the contacting portions face each other, wherein each elasticity-reinforcing member sandwiches the two contacts constituting the corresponding contact pair at outer sides of the facing contacting portions of the two contacts and comes into contact with the two contacts while maintaining insulation property.

8 Claims, 5 Drawing Sheets

(56) References Cited

U.S. PATENT DOCUMENTS

| | | | | |
|---|---|---|---|---|
| 6,454,610 | B1 * | 9/2002 | Yu | H01R 13/641 439/660 |
| 7,544,104 | B2 * | 6/2009 | Fan | H01R 12/52 439/65 |
| 7,635,274 | B2 * | 12/2009 | Fukazawa | H01R 12/716 439/247 |
| 7,862,345 | B2 * | 1/2011 | Fukazawa | H01R 12/716 439/74 |
| 8,152,548 | B2 * | 4/2012 | Masuda | H01R 12/716 439/291 |
| 9,088,113 | B2 * | 7/2015 | Funayama | H01R 12/91 |
| 9,270,045 | B2 * | 2/2016 | Kimura | H01R 13/41 |

* cited by examiner

PRIOR ART

CONNECTOR

BACKGROUND OF THE INVENTION

The present invention relates to a connector, in particular, to reinforcement of contacts having elasticity.

Conventionally, a connector that establishes electrical connection through engagement between a plug and a receptacle has been widely used in various electronic devices. The plug and the receptacle have contacts, and the contacts of the plug come into contact with the contacts of the receptacle. Typically, the contacts of at least one of the plug and the receptacle elastically deform and come into contact with the contacts of the other when the plug and the receptacle are fitted, whereby the contact force is generated between the contacts of the plug and the contacts of the receptacle to ensure electrical connection therebetween.

Recently, as electronic devices decrease in size while increasing in density, a smaller multipolar connector in which a plurality of contacts are mounted at a narrower pitch is required, and accordingly use of the smaller contact is desired.

However, as the contact decreases in size, elasticity of the contact also decreases, and thus the contact force between the contacts of the plug and the contacts of the receptacle decreases when the plug and the receptacle are fitted, or the respective contacts are likely to plastically deform. As a result, it becomes difficult to realize a reliable conduction state.

Accordingly, JP 2013-55007 A, for example, discloses a connector in which a plurality of receptacle contacts 2 arranged in two arrays are held by a receptacle housing 1, and an elasticity-reinforcing member 4 is provided between receptacle contact contacting portions 3 of a pair of receptacle contacts 2 facing each other, as illustrated in FIG. 15. The elasticity-reinforcing member 4 reinforces the contact forces of the receptacle contact contacting portions 3 to corresponding plug contact contacting portions 6, thereby realizing a stable conduction state between the receptacle contact contacting portions 3 and the plug contact contacting portions 6.

In the connector disclosed in JP 2013-55007 A, the elasticity-reinforcing member 4 presses the receptacle contact contacting portion 3 to reinforce the contact force, but the elasticity-reinforcing member 4 merely presses one side of the receptacle contact contacting portion 3 that has a U-shape and is fixed to the receptacle housing 1, while the other side of the receptacle contact contacting portion 3 is held by the receptacle housing 1 to receive the pressing force from the elasticity-reinforcing member 4, so that the other side of the receptacle contact contacting portion 3 cannot shift.

Accordingly, when plug contacts 5 of a counter-connector have unevenness in arrangement, the corresponding receptacle contacts 2 cannot shift to follow the plug contacts 5 of the counter-connector, and the unevenness of arrangement of the plug contacts 5 cannot be absorbed.

SUMMARY OF THE INVENTION

The present invention has been made to overcome the above problem associated with the prior art and aims at providing a connector that can establish reliable connection even when a plurality of contacts of a counter-connector have unevenness in arrangement.

A connector of the present invention includes a housing, a plurality of contact pairs arranged on and fixed to the housing, each of the contact pairs being consisted of two contacts that are insulated from each other, and a plurality of elasticity-reinforcing members corresponding to the plurality of contact pairs, each of the elasticity-reinforcing members being not fixed to the housing but held by a corresponding contact pair among the plurality of contact pairs, wherein the two contacts constituting each of the plurality of contact pairs respectively include contacting portions that come into contact with corresponding contacts of a counter-connector, are made of elastic contact pieces extending in a fitting direction with the counter-connector and are disposed such that the contacting portions face each other, and wherein each of the elasticity-reinforcing members sandwiches the two contacts constituting the corresponding contact pair at outer sides of the facing contacting portions of the two contacts and comes into contact with the two contacts, while maintaining insulation property.

DETAILED DESCRIPTION OF THE INVENTION

Embodiments of the present invention will be described below based on the appended drawings.

Embodiment 1

Figure 1:
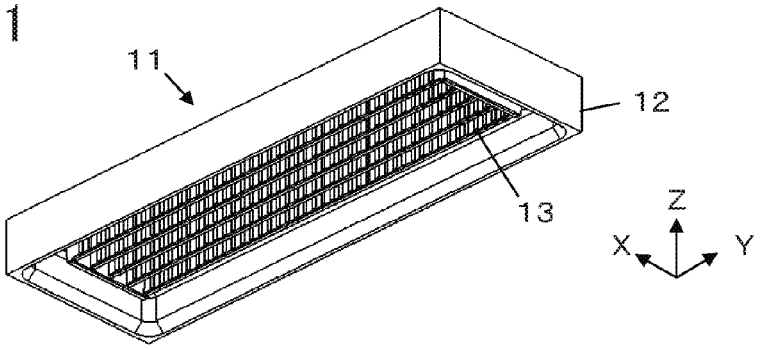
FIG. 1 is a perspective view showing a plug of a connector according to Embodiment 1 of the present invention.

FIG. 1 shows a plug 11 of a connector according to Embodiment 1 of the present invention. The plug 11 includes a plug housing 12 made of an insulating material and having a box shape which opens downward, and a plurality of plug contacts 13 are arranged inside the plug housing 12 in a matrix state.

Figure 2:
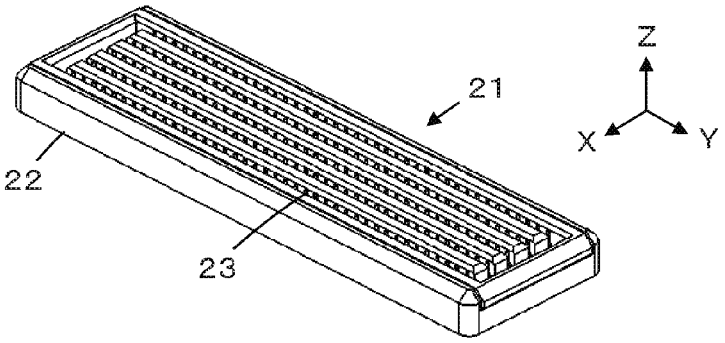
FIG. 2 is a perspective view showing a receptacle of the connector according to Embodiment 1.

FIG. 2 shows a receptacle 21 of the connector. The receptacle 21 includes a receptacle housing 22 made of an insulating material and having a planar plate shape, and a plurality of receptacle contacts 23 are arranged on the receptacle housing 22 in a matrix state.

The plug housing 12 is placed over and engaged with the receptacle housing 22, whereby the plurality of plug contacts 13 and the plurality of receptacle contacts 23 are connected together.

As a matter of convenience, a plane along which the plurality of plug contacts 13 as well as the plurality of receptacle contacts 23 are arranged is referred to as XY plane, while a fitting direction of the plug 11 and receptacle 21 is referred to as Z direction. Each of the plug contacts 13 of the plug 11 extends in the −Z direction, whereas each of the receptacle contacts 23 of the receptacle 21 extends in the +Z direction.

Figure 3:
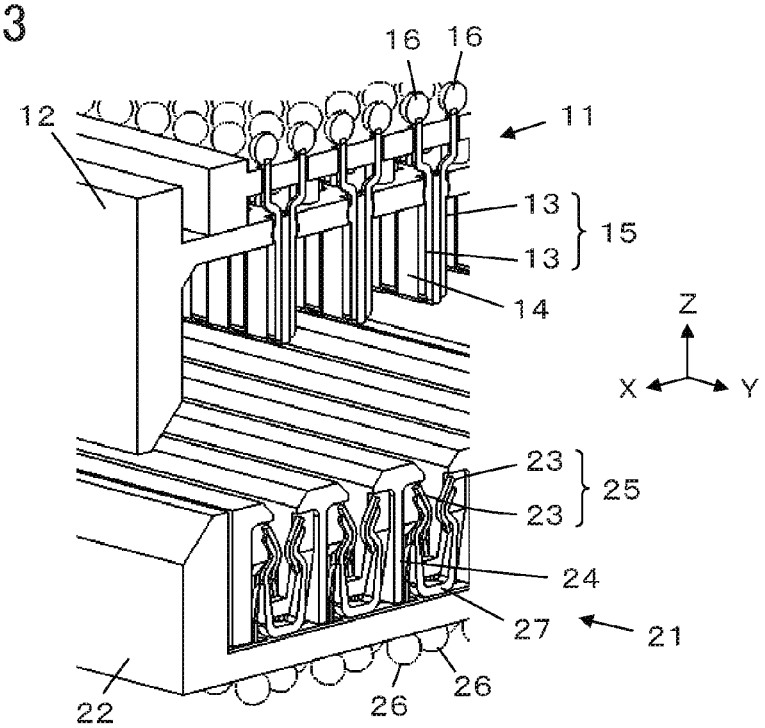
FIG. 3 is an enlarged broken perspective view partially showing the plug and the receptacle of the connector according to Embodiment 1.

As illustrated in FIG. 3, the plug housing 12 of the plug 11 includes a plurality of contact-holding walls 14 each extending along the YZ plane and arranged in the X direction with intervals therebetween, and two plug contacts 13 constituting a plug contact pair 15 are respectively arranged on opposite surfaces of each of the contact-holding walls 14 so as to sandwich the contact-holding wall 14. The plug contacts 13 are each made of a pin-type contact piece having no spring property, have their ends in the −Z direction extending in parallel to each other toward the receptacle 21, and have their ends in the +Z direction protruding from the plug housing 12 toward the +Z direction to be connected to the corresponding solder balls 16. A plurality of the plug contact pairs 15 are placed in the above-described manner and arranged in a plurality of arrays along the plurality of contact-holding walls 14.

Meanwhile, the receptacle housing 22 of the receptacle 21 includes a plurality of partition walls 24 each extending along the YZ plane and arranged in the X direction with intervals therebetween, and two receptacle contacts 23 constituting a receptacle contact pair 25 are arranged so as to face each other in the X direction in each of receptacle contact accommodation portions formed by separating a space with the partition walls 24. The receptacle contacts 23 are each made of an elastic contact piece having spring property, have their ends in the +Z direction extending toward the plug 11, and have their ends in the −Z direction protruding from the receptacle housing 22 toward the −Z direction to be connected to the corresponding solder balls 26. A plurality of the receptacle contact pairs 25 are placed in the above-described manner and arranged in a plurality of receptacle contact accommodation portions separated by the plurality of partition walls 24.

Each of the receptacle contact pairs 25 holds an elasticity-reinforcing member 27. The elasticity-reinforcing member 27 reinforces elasticity of the two receptacle contacts 23 constituting each of the receptacle contact pairs 25 and enhances the contact force to the corresponding plug contacts 13.

The elasticity-reinforcing member 27 is made of a metal sheet having elasticity, and an entire surface of the elasticity-reinforcing member 27 is covered by an insulation layer made of an insulating resin or the like.

Figure 4:
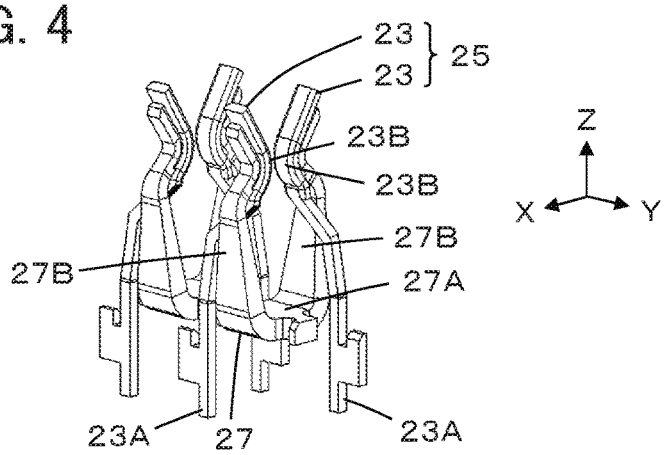
FIGS. 4 to 6 are a perspective view, a side view and a front view, respectively, each illustrating receptacle contacts and elasticity-reinforcing members used in the receptacle of the connector according to Embodiment 1.

As illustrated in FIG. 4, each of the two receptacle contacts 23 constituting the receptacle contact pair 25 has a cantilever shape extending in the Z direction, and includes a substrate-mounting portion 23A that protrudes from the receptacle housing 22 toward the −Z direction to be connected to the corresponding solder ball 26 and a contacting portion 23B that is located in the vicinity of the end in the +Z direction. The contacting portions 23B of the two receptacle contacts 23 are positioned on a single XZ plane and curve within the XZ plane in such a manner that convex parts of their curves face each other in a close relation in the X direction.

Figure 5:
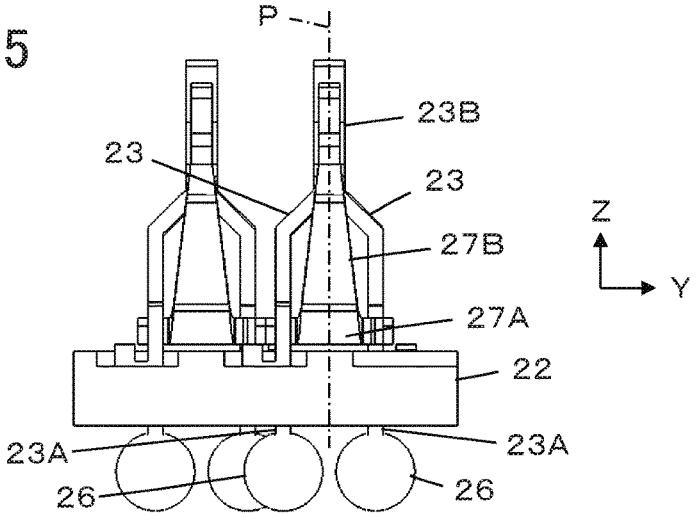

As illustrated in FIG. 5, the two receptacle contacts 23 constituting the receptacle contact pair 25 are formed such that, having the XZ plane on which the two contacting portions 23B are located as a shifting plane P, the contacting portions 23B elastically deform on the shifting plane P. The substrate-mounting portions 23A of the two receptacle contacts 23 are arranged not on the shifting plane P but on opposite sides with respect to the shifting plane P, i.e., on the +Y direction side and on the −Y direction side of the shifting plane P, respectively. As a result, the plurality of receptacle contact pairs 25 arranged in the Y direction have the plurality of substrate-mounting portions 23A arranged in zigzag arrangement.

In the meantime, the elasticity-reinforcing member 27 is a substantially U-shaped member disposed on the shifting plane P and includes a base portion 27A located between the substrate-mounting portions 23A of the two receptacle contacts 23 that are respectively arranged on opposite sides with respect to the shifting plane P and a pair of arm portions 27B extending from the base portion 27A toward the +Z direction with an interval in the X direction therebetween. Relative to the elasticity-reinforcing member 27, each of the receptacle contacts 23 has a bent shape that extends from the substrate-mounting portion 23A, enters inside the elasticity-reinforcing member 27 having a U-shape and reaches the contacting portion 23B.

Figure 6:
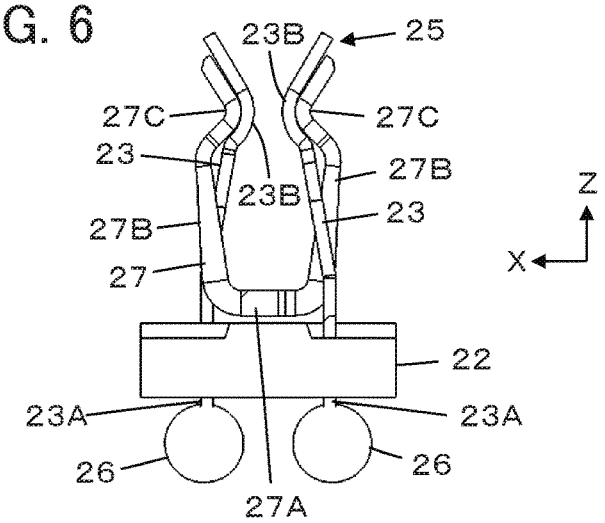

In addition, the elasticity-reinforcing member 27 includes a pair of bending portions 27C provided near ends of the pair of arm portions 27B in the +Z direction, as illustrated in FIG. 6. The bending portions 27C each bend in the XZ plane such that convex parts of their bends face each other in the X direction. A pair of such bending portions 27C come into contact with outer sides of the curved contacting portions 23B of the two receptacle contacts 23 constituting the receptacle contact pair 25, and accordingly the elasticity-reinforcing member 27 elastically sandwiches the facing contacting portions 23B of the two receptacle contacts 23 at outer sides thereof. The elasticity-reinforcing member 27 is not fixed to the receptacle housing 22 but is held by the receptacle contact pair 25 that is consisted of the two receptacle contacts 23 in this way.

Figure 7:
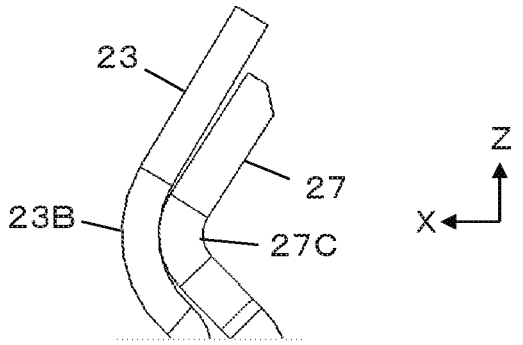
FIG. 7 is a front view illustrating a contact portion between the receptacle contact and the elasticity-reinforcing member in the connector according to Embodiment 1.

As illustrated in FIG. 7, the bending portion 27C of the elasticity-reinforcing member 27 comes in contact with an outer side of the curved contacting portion 23B of the receptacle contact 23. Since an entire surface of the elasticity-reinforcing member 27 is covered by the insulation layer made of an insulating resin or the like as described above, the elasticity-reinforcing member 27 contacts with the receptacle contact 23 while maintaining insulation property. Therefore, even when a pair of bending portions 27C of one elasticity-reinforcing member 27 respectively come into contact with outer sides of the contacting portions 23B of the two receptacle contacts 23 constituting the receptacle contact pair 25, the two receptacle contacts 23 would not short-circuit via the elasticity-reinforcing member 27.

In this manner, the plurality of receptacle contact pairs 25 respectively hold the corresponding elasticity-reinforcing members 27, and two receptacle contacts 23 constituting each of the receptacle contact pairs 25 are elastically sandwiched by each of the elasticity-reinforcing members 27 at outer sides of the facing contacting portions 23B.

When the plug 11 is fitted with the receptacle 21, each of the plug contact pairs 15 of the plug 11 is inserted between the corresponding receptacle contact pair 25 of the receptacle 21, and two plug contacts 13 constituting each of the plug contact pairs 15 respectively come into contact with the corresponding contacting portions 23B of two receptacle contacts 23 constituting each of the receptacle contact pairs 25. At this time, the facing contacting portions 23B of the two receptacle contacts 23 are applied with a force in the X direction by the two plug contacts 13 constituting the plug contact pair 15 such that the distance between the contacting portions 23B increases. As a result, the two receptacle contacts 23 both elastically deform in the XZ plane, while a pair of arm portions 27B of the elasticity-reinforcing member 27 held by the two receptacle contacts 23 also elastically deform such that the distance between the pair of arm portions 27B increases.

Hence, resilience is generated on the elasticity-reinforcing member 27 due to its elasticity, the contacting portions 23B of the two receptacle contacts 23 are applied with forces in the X direction by the pair of bending portions 27C of the elasticity-reinforcing member 27 such that the distance between the contacting portions 23B decreases. As a result, the contact force of the contacting portion 23B of each of the receptacle contacts 23 applied to the corresponding plug contact 13 is reinforced, thereby realizing a stable conduction state between the receptacle contact 23 and the plug contact 13.

Since each of the receptacle contacts 23 is formed of the elastic contact piece extending in the Z direction, and each of the elasticity-reinforcing members 27 is not fixed to the receptacle housing 22 but held by the corresponding receptacle contact pair 25, even if the plug 11 has unevenness in the arrangement of the plug contacts 13, the respective receptacle contacts 23 shift so as to follow the corresponding plug contacts 13, whereby unevenness of arrangement of the plug contacts 13 can be absorbed, while the contact forces of the receptacle contacts 23 are reinforced by the elasticity-reinforcing members 27.

In addition, since the contact forces of two receptacle contacts 23 constituting the receptacle contact pair 25 are reinforced by one elasticity-reinforcing member 27, the connector can be decreased in size.

Furthermore, each of the elasticity-reinforcing members 27 is simply held by the corresponding receptacle contact pair 25 and reinforces the contact forces, and the receptacle housing 22 does not need to receive reaction forces from reinforcement of the contact forces but only needs to hold the plurality of receptacle contacts 23. Accordingly, a wall thickness of the receptacle housing 22 can be thinner, and the connector can be further decreased in size.

In Embodiment 1 described above, while each of the elasticity-reinforcing members 27 elastically sandwiches the two receptacle contacts 23 at outer sides of their facing contacting portions 23B to be thereby held by the receptacle contact pair 25 that is consisted of the two receptacle contacts 23, the pair of bending portions 27C of the elasticity-reinforcing member 27 may be respectively adhered to the outer sides of the contacting portions 23B of the two receptacle contacts 23. With such constitution, the receptacle contacts 23 and the elasticity-reinforcing member 27 can be easily assembled to the receptacle housing 22 in the manufacture of the connector.

The insulation layer covering the elasticity-reinforcing member 27 can be formed by, for example, coating an insulating material such as polyimide over an entire surface of the elasticity-reinforcing member 27. Alternatively, the insulation material may be vapor-deposited. While the insulation layer is formed on the entire surface of the elasticity-reinforcing member 27 in Embodiment 1 described above, this is not the sole case, and the insulation layer may be formed only around the bending portions 27C of the elasticity-reinforcing member 27, the bending portions 27C coming into contact with the outer sides of the contacting portions 23B of the receptacle contacts 23.

Figure 8:
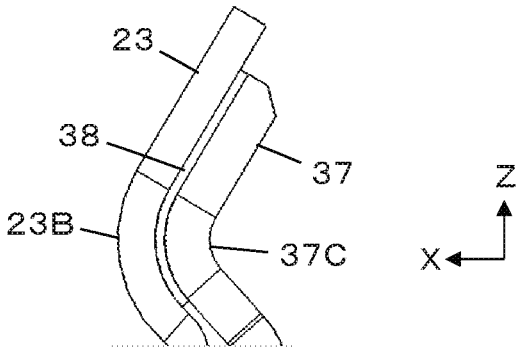
FIG. 8 is a front view illustrating a contact portion between a receptacle contact and an elasticity-reinforcing member in a connector according to a variation of Embodiment 1.

As illustrated in FIG. 8, it is also possible to provide an insulation sheet 38 around a bending portion 37C of an elasticity-reinforcing member 37 between the elasticity-reinforcing member 37 and the outer side of the contacting portion 23B of the corresponding receptacle contact 23, the elasticity-reinforcing member 37 being made of a metal sheet on a surface of which no insulation layer is formed, whereby the elasticity-reinforcing member 37 comes into contact with the receptacle contact 23 via the insulation sheet 38. The insulation sheet 38 may be adhered to either the elasticity-reinforcing member 37 or the receptacle contact 23, or alternatively, the insulation sheet 38 may be sandwiched by and held between the elasticity-reinforcing member 37 and the receptacle contact 23 without being adhered to either of the elasticity-reinforcing member 37 and the receptacle contact 23.

Embodiment 2

Figure 9:
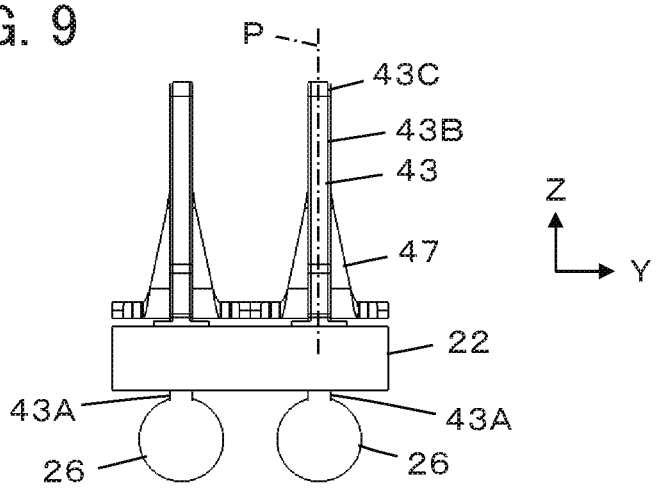
FIGS. 9 and 10 are a side view and a front view, respectively, each illustrating receptacle contacts and elasticity-reinforcing members used in a receptacle of a connector according to Embodiment 2.
Figure 10:
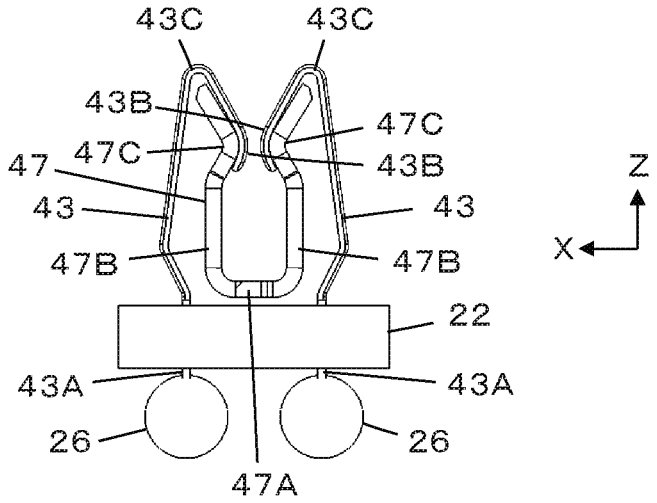

FIGS. 9 and 10 illustrate receptacle contacts 43 and elasticity-reinforcing members 47 in a receptacle of a connector according to Embodiment 2. Two receptacle contacts 43 constituting a receptacle contact pair each have a cantilever shape extending in the Z direction and are respectively provided with substrate-mounting portions 43A that project from the receptacle housing 22 in the −Z direction to be connected to solder balls 26, bent portions 43C positioned at the end in the +Z direction, and contacting portions 43B positioned on the −Z direction side of the bent portions 43C.

The bent portions 43C of the two receptacle contacts 43 are both bent in the −Z direction, while extending toward each other. In addition, the contacting portions 43B of the two receptacle contacts 43 both curve in the XZ plane such that the convex portions of their curves face each other in a close relation in the X direction.

The substrate-mounting portions 43A, the bent portions 43C and the contacting portions 43B of the two receptacle contacts 43 are positioned on a shifting plane P that is a single XZ plane and are formed such that each of the contacting portions 43B elastically displace on the shifting plane P.

The elasticity-reinforcing member 47 is a substantially U-shaped member disposed on the shifting plane P and includes a base portion 47A located between substrate-mounting portions 43A of the two receptacle contacts 43 and a pair of arm portions 47B extending from the base portion 47A toward the +Z direction with an interval in the X direction therebetween. Relative to the elasticity-reinforcing member 47, each of the receptacle contacts 43 has a bent shape that extends from the substrate-mounting portion 43A in the Z direction, which is the fitting direction of the connector, outside the elasticity-reinforcing member 47 having a U-shape and then is bent at the bent portion 43C to reach the contacting portion 43B.

In addition, the elasticity-reinforcing member 47 includes a pair of bending portions 47C respectively arranged near the ends of the pair of arm portions 47B in the +Z direction. The bending portions 47C bend in the XZ plane such that convex portions thereof face each other in the X direction.

As the pair of bending portions 47C come into contact with outer sides of the curved contacting portions 43B of the two receptacle contacts 43, the elasticity-reinforcing member 47 elastically sandwiches the two receptacle contacts 43 at the outer sides of the facing contacting portions 43B. The elasticity-reinforcing member 47 is not fixed to the receptacle housing 22 but held by the receptacle contact pair that is consisted of the two receptacle contacts 43 in this way.

Figure 11:
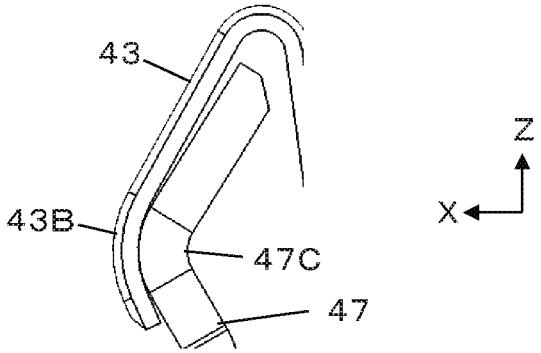
FIG. 11 is a front view illustrating a contact portion between the receptacle contact and the elasticity-reinforcing member in the connector according to Embodiment 2.

Furthermore, the elasticity-reinforcing member 47 has its entire surface covered by an insulation layer, similarly to the elasticity-reinforcing member 27 in Embodiment 1. Thus, as illustrated in FIG. 11, even if the bending portion 47C of the elasticity-reinforcing member 47 comes into contact with the outer side of the curved contacting portion 43B of the receptacle contact 43, the elasticity-reinforcing member 47 contacts with the receptacle contact 43 while maintaining insulation property.

Using the receptacle contact 43 and the elasticity-reinforcing member 47 as described above, the contact force of the contacting portion 43B of each of the receptacle contacts 43 applied to the corresponding plug contact 13 can be also reinforced, thereby realizing a stable conduction state between the receptacle contact 43 and the plug contact 13.

In addition, even if the plug contacts 13 of the plug 11 have unevenness in arrangement, the respective receptacle contacts 43 shift so as to follow the corresponding plug contacts 13, whereby unevenness of arrangement of the plug contacts 13 can be absorbed, while the contact forces of the receptacle contacts 43 are reinforced by the elasticity-reinforcing members 47.

Furthermore, since the contact forces of the two receptacle contacts 43 constituting the receptacle contact pair are reinforced by one elasticity-reinforcing member 47, the connect can be decreased in size.

Similarly to the elasticity-reinforcing member 27 in Embodiment 1, the pair of bending portions 47C of the elasticity-reinforcing member 47 may be respectively adhered to outer sides of the contacting portions 43B of the two receptacle contacts 43.

In addition, in place of the insulation layer formed over the entire surface of the elasticity-reinforcing member 47, an insulation layer may be formed only around the bending portions 47C of the elasticity-reinforcing member 47, the bending portions 47C coming into contact with the outer sides of the contacting portions 43B of the receptacle contacts 43.

Figure 12:
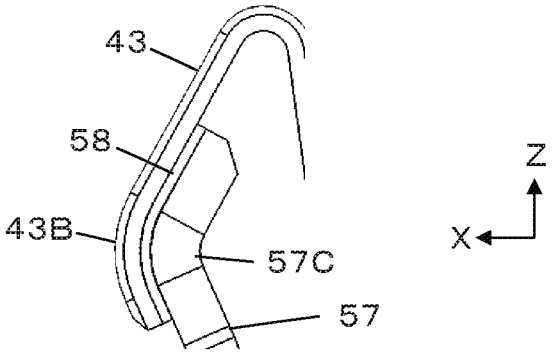
FIG. 12 is a front view illustrating a contact portion between a receptacle contact and an elasticity-reinforcing member in a connector according to a variation of Embodiment 2.

Moreover, as illustrated in FIG. 12, it is also possible to provide an insulation sheet 58 around a bending portion 57C of an elasticity-reinforcing member 57 between the elasticity-reinforcing member 57 and the outer side of the contacting portion 43B of the corresponding receptacle contact 43, the elasticity-reinforcing member 57 being made of a metal sheet on whose surface no insulation layer is formed, whereby the elasticity-reinforcing member 57 comes into contact with the receptacle contact 43 via the insulation sheet 58. The insulation sheet 58 may be adhered to either the elasticity-reinforcing member 57 or the receptacle contact 43, or alternatively, the insulation sheet 58 may be sandwiched by and held between the elasticity-reinforcing member 57 and the receptacle contact 43 without being adhered to either of the elasticity-reinforcing member 57 and the receptacle contact 43.

Embodiment 3

Figure 13:
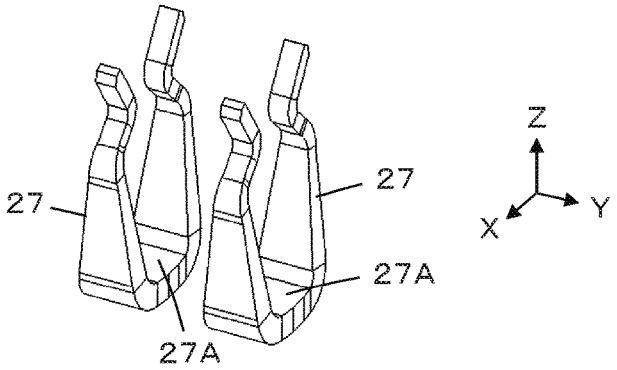
FIG. 13 is a perspective view illustrating elasticity-reinforcing members in a connector according to Embodiment 3.

As illustrated in FIG. 13, a plurality of elasticity-reinforcing members 27 arranged independently without being connected to one another may be used.

Since each of the elasticity-reinforcing members 27 is held by the corresponding receptacle contact pair 25 and can shift together with the corresponding receptacle contact pair 25, the plurality of elasticity-reinforcing members 27 can absorb unevenness of arrangement of the plug contacts 13, while reinforcing the contact force of the receptacle contacts 23.

Similarly, the elasticity-reinforcing members 37, 47 and 57 in Embodiments 1 and 2 may also be used with being independent of one another.

Figure 14:
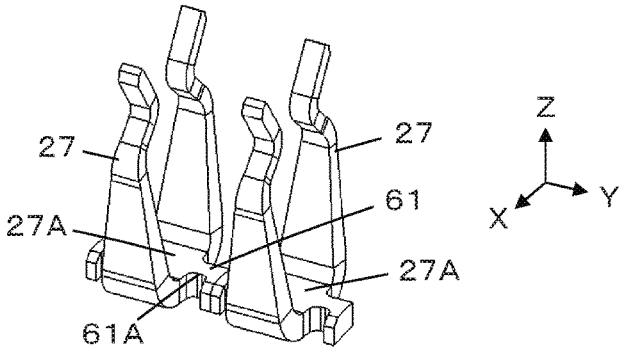
FIG. 14 is a perspective view illustrating elasticity-reinforcing members in a connector according to a variation of Embodiment 3.
Figure 15:
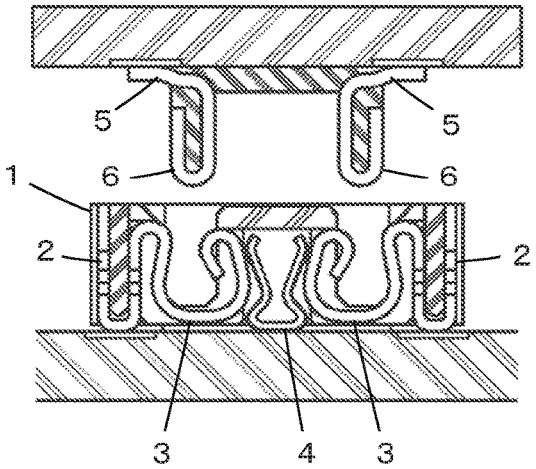
FIG. 15 is a cross-sectional view illustrating the structure of a conventional connector.

As illustrated in FIG. 14, the plurality of elasticity-reinforcing members 27 arranged in the Y direction, in which a plurality of receptacle contact pairs are arranged, may be connected to one another. Base portions 27A of two elasticity-reinforcing members 27 that are adjacent to each other in the Y direction are connected together via an elastically-connecting portion 61. The elastically-connecting portion 61 has a constricted portion 61A that is formed in the X direction orthogonal to both the Y direction and the Z direction, the Y direction being the arrangement direction of the plurality of receptacle contact pairs and the Z direction being the fitting direction of the connector, and the two base portions 27A are connected to be shiftable at least in the X direction.

Even when the plurality of elasticity-reinforcing members 27 are connected to one another via such elastically-connecting portions 61, the elasticity-reinforcing members 27 can shift in the X direction so as to be able to absorb unevenness of arrangement of the plug contacts 13, while reinforcing the contact force of the receptacle contacts 23.

In addition, as the plurality of elasticity-reinforcing members 27 are connected to one another, the plurality of elasticity-reinforcing members 27 can be easily assembled to the receptacle housing 22 in the manufacture of the connector.

Similarly, the elasticity-reinforcing members 37, 47 and 57 in Embodiments 1 and 2 may also be used as being connected to one another via the elastically-connecting portions 61.

While the elasticity-reinforcing members reinforce the contact forces of the receptacle contacts in Embodiments 1 to 3 described above, a plug may be provided with elasticity-reinforcing members to reinforce the contact forces of plug contacts in a connector in which the plug contacts elastically deform as the plug and a receptacle are fitted.

According to the present invention, even in a small-size, multipole connector in which the solder balls 16 of the plug 11 and the solder balls 26 of the receptacle 21 illustrated in FIG. 3 are arranged at a pitch of 0.5 mm, for example, the contact forces of the contacts can be reinforced while unevenness of arrangement of the contacts is absorbed, without decreasing a packaging density of the contacts, whereby reliability of the connector can be improved.

What is claimed is:

1. A connector comprising:

a housing;

a plurality of contact pairs arranged on and fixed to the housing, each of the contact pairs being consisted of two contacts that are insulated from each other; and a plurality of elasticity-reinforcing members corresponding to the plurality of contact pairs, each of the elasticity-reinforcing members being not fixed to the housing but held by a corresponding contact pair among the plurality of contact pairs, wherein the two contacts constituting each of the plurality of contact pairs respectively include contacting portions that come into contact with corresponding contacts of a counter-connector, are made of elastic contact pieces extending in a fitting direction with the counter-connector and are disposed such that the contacting portions face each other, and wherein each of the elasticity-reinforcing members sandwiches the two contacts constituting the corresponding contact pair at outer sides of the facing contacting portions of the two contacts and comes into contact with the two contacts while maintaining insulation property.

2. The connector according to claim 1, wherein the plurality of elasticity-reinforcing members are connected to one another via elastically-connecting portions to be shiftable in a direction orthogonal to both an arrangement direction of the plurality of contact pairs and the fitting direction.

3. The connector accordingly to claim 2, wherein each of the elastically-connecting portions has a constricted portion formed in the direction orthogonal to both the arrangement direction of the plurality of contact pairs and the fitting direction.

4. The connector according to claim 1, wherein the two contacts constituting each of the plurality of contact pairs have the facing contacting portions that elastically shift on a single shifting plane and include a pair of substrate-mounting portions respectively disposed on opposite sides with respect to the shifting plane, wherein each of the elasticity-reinforcing members is made of a U-shaped member disposed on the shifting plane and having a pair of end portions that respectively come into contact with the outer sides of the contacting portions of the two contacts, and wherein the two contacts respectively have bent shapes that extend from the substrate-mounting portions, enter inside each of the elasticity-reinforcing members and reach the contacting portions.

5. The connector according to claim 1, wherein the two contacts constituting each of the plurality of contact pairs have the facing contacting portions that elastically shift on a single shifting plane and include a pair of substrate-mounting portions respectively disposed on the shifting plane, wherein each of the elasticity-reinforcing members is made of a U-shaped member disposed on the shifting plane and having a pair of end portions that respectively come into contact with the outer sides of the contacting portions of the two contacts, and wherein the two contacts respectively have bent shapes that extend from the pair of substrate-mounting portions in the fitting direction outside each of the elasticity-reinforcing members and then are bent to reach the contacting portions.

6. The connector according to claim 1, wherein each of the elasticity-reinforcing members is made of a metal sheet on a surface of which an insulation layer is formed.

7. The connector according to claim 1, wherein each of the elasticity-reinforcing members is made of a metal sheet that comes into contact with the two contacts via an insulation sheet.

8. The connector according to claim 1, wherein the plurality of contact pairs are arranged on the housing in a plurality of arrays.

* * * * *